US011214972B2

(12) United States Patent
Bayless et al.

(10) Patent No.: US 11,214,972 B2
(45) Date of Patent: Jan. 4, 2022

(54) FLOOR SUPPORT

(71) Applicant: Alabama Foundation Specialists, Inc., Huntsville, AL (US)

(72) Inventors: Benjamin Bayless, Chattanooga, TN (US); James Andrew Burran, Chattanooga, TN (US); Michael Cox, Chattanooga, TN (US)

(73) Assignee: AFS Newco, LLC, Virginia Beach, VA (US)

( * ) Notice: Subject to any disclaimer, the term of this patent is extended or adjusted under 35 U.S.C. 154(b) by 0 days.

(21) Appl. No.: 16/748,923

(22) Filed: Jan. 22, 2020

(65) Prior Publication Data

US 2020/0240157 A1 Jul. 30, 2020

Related U.S. Application Data

(60) Provisional application No. 62/796,176, filed on Jan. 24, 2019.

(51) Int. Cl.

| | |
|---|---|
| ***E04G 23/02*** | (2006.01) |
| ***E04F 15/024*** | (2006.01) |
| ***B66F 3/08*** | (2006.01) |

(52) U.S. Cl.

CPC ..... *E04G 23/024* (2013.01); *B66F 3/08* (2013.01); *E04F 15/0247* (2013.01); *E04F 15/02452* (2013.01); *B66F 2700/04* (2013.01)

(58) Field of Classification Search

CPC ..... E04G 23/024; E04F 15/0247; E04F 15/02476; E04F 15/02464; E04F 2015/02127; B66F 3/08

USPC ..... 52/11, 126.4, 126.5, 126.7, 506.06; 248/125.2, 125.8, 188.4, 188.5

See application file for complete search history.

(56) References Cited

U.S. PATENT DOCUMENTS 789,071 A * 5/1905 Schroer ..... B66F 3/08 254/98
804,662 A * 11/1905 Johnston ..... B66F 3/08 254/98
2,776,811 A * 1/1957 Shaffer ..... E04G 25/061 248/542
2,947,515 A * 8/1960 Shaffer ..... E04G 25/061 254/100
3,222,030 A * 12/1965 Thorpe ..... E04F 15/02452 254/100
3,398,933 A * 8/1968 Haroldson ..... B66F 3/08 254/98
3,425,179 A * 2/1969 Haroldson ..... E04F 15/02452 52/283
3,616,584 A * 11/1971 Sartori et al. ..... E04F 15/02452 52/126.6
4,122,645 A * 10/1978 Tooley ..... E04G 11/486 52/651.1

(Continued)

FOREIGN PATENT DOCUMENTS

JP 2009138493 A * 6/2009 ..... E04F 15/0247

*Primary Examiner* — Brent W Herring

(74) *Attorney, Agent, or Firm* — Jeremy A. Smith; Lanier Ford Shaver & Payne, PC

(57) ABSTRACT

The present disclosure provides a support system comprising a post, said post extending upward vertically from a pad and further comprising upper and lower ends, wherein said lower end is secured to a lower flange; and a joist flange secured to the post opposite the lower flange; wherein the lower flange is secured to the post via a frictional fit.

8 Claims, 3 Drawing Sheets

(56) References Cited

U.S. PATENT DOCUMENTS 4,558,544 A * 12/1985 Albrecht ..... E04F 15/0247 52/126.1
4,780,571 A * 10/1988 Huang ..... E04F 15/02452 174/484
4,899,497 A * 2/1990 Madl, Jr. ..... E04B 1/0007 52/126.6
4,996,804 A * 3/1991 Naka ..... E04F 15/02452 52/126.1
5,152,108 A * 10/1992 Madl, Jr. ..... E02D 27/02 52/126.1
5,333,423 A * 8/1994 Propst ..... E04F 15/02476 248/188
5,561,950 A * 10/1996 Collins ..... E02D 27/32 248/354.3
5,971,362 A * 10/1999 Clark ..... E04F 21/1872 254/100
6,217,005 B1 * 4/2001 Scott ..... B66F 3/08 254/100
6,363,685 B1 * 4/2002 Kugler ..... E04F 15/02183 52/126.6
6,581,911 B1 * 6/2003 Scott ..... B66F 3/08 254/100
7,866,096 B2 * 1/2011 Lee ..... E04F 15/02488 52/126.6
8,122,612 B2 * 2/2012 Knight, III ..... E04F 15/02183 33/836
8,156,701 B2 * 4/2012 Tsukada ..... E04F 15/22 52/263
8,162,289 B2 * 4/2012 McCaleb ..... E04F 15/0247 254/98
8,397,442 B2 * 3/2013 Laurin ..... E02D 27/32 52/126.6
2004/0163334 A1 * 8/2004 Carlson ..... E04F 15/02458 52/126.6
2004/0163350 A1 * 8/2004 Huang ..... E04F 15/02452 52/506.06
2004/0261329 A1 * 12/2004 Kugler ..... E04F 15/02183 52/126.6
2008/0222973 A1 * 9/2008 Lee ..... E04F 15/02488 52/126.1
2008/0308777 A1 * 12/2008 McCaleb ..... E04G 23/0218 254/98
2009/0145057 A1 * 6/2009 Tsukada ..... E04F 15/0247 52/126.6
2017/0067262 A1 * 3/2017 Kugler ..... E04F 15/02476
2020/0039801 A1 * 2/2020 Sargent ..... E04D 11/007

* cited by examiner

FLOOR SUPPORT

CROSS REFERENCE TO RELATED APPLICATIONS

This application claims priority to and the benefit of U.S. Provisional Patent Application No. 62/796,176 filed on Jan. 24, 2019.

BACKGROUND

Over time, the flooring over a crawl space or basement can shift and settle due to sagging floor joists, and support beams (referred to as joists for the remainder of the document for simplicity). Structural support jacks are often installed to raise the floor joists and level the floors. Conventional support jacks will extend between the ground and a joist under a house. To install the support jacks, a hole is typically dug into the ground and a solid base of fill, typically concrete, is established under the location where the jack will be placed. The support jack is then placed on the base under the joist and extended up to push the joist upward and level the floor.

A floor support system according to the present disclosure improves upon the conventional floor support systems by providing a post that is secured to a base at its bottom end and to the joist at its top end centered on its base and adjustably lengthened to jack up the joist. Additionally, the system disclosed herein may be used to support any beam running over a span.

SUMMARY OF THE INVENTION

In a first aspect, the present disclosure provides a post, said post extending upward vertically from a pad and further comprising upper and lower ends, wherein said lower end is secured to a lower flange; and a joist flange secured to the post opposite the lower flange; wherein, the lower flange is secured to the post via a frictional fit.

In a second aspect, the present disclosure provides a floor support system comprising a post vertically disposed between a pad and a floor joist, said post comprising upper and lower ends, wherein said lower end is secured to a lower flange and said upper end is secured to a joist flange secured wherein, the lower flange and the joist flange move independently relative the post from one another.

In a third aspect, the present disclosure provides a floor support system comprising a post, said post extending upward vertically from the pad and further comprising upper and lower ends, wherein said lower end is secured to a lower flange, said lower flange comprising a raised centering guide; an upper insert, said upper insert comprising a raised centering guide which is inserted into the upper end of the post wherein, the lower flange and the upper insert are secured to the post via a frictional fit.

BRIEF DESCRIPTION OF THE DRAWINGS

The disclosure can be better understood with reference to the following drawings. The elements of the drawings are not necessarily to scale, emphasis instead being placed upon clearly illustrating the principles of the disclosure. Furthermore, like reference numerals designate corresponding parts throughout the several views.

DETAILED DESCRIPTION

Figure 1:
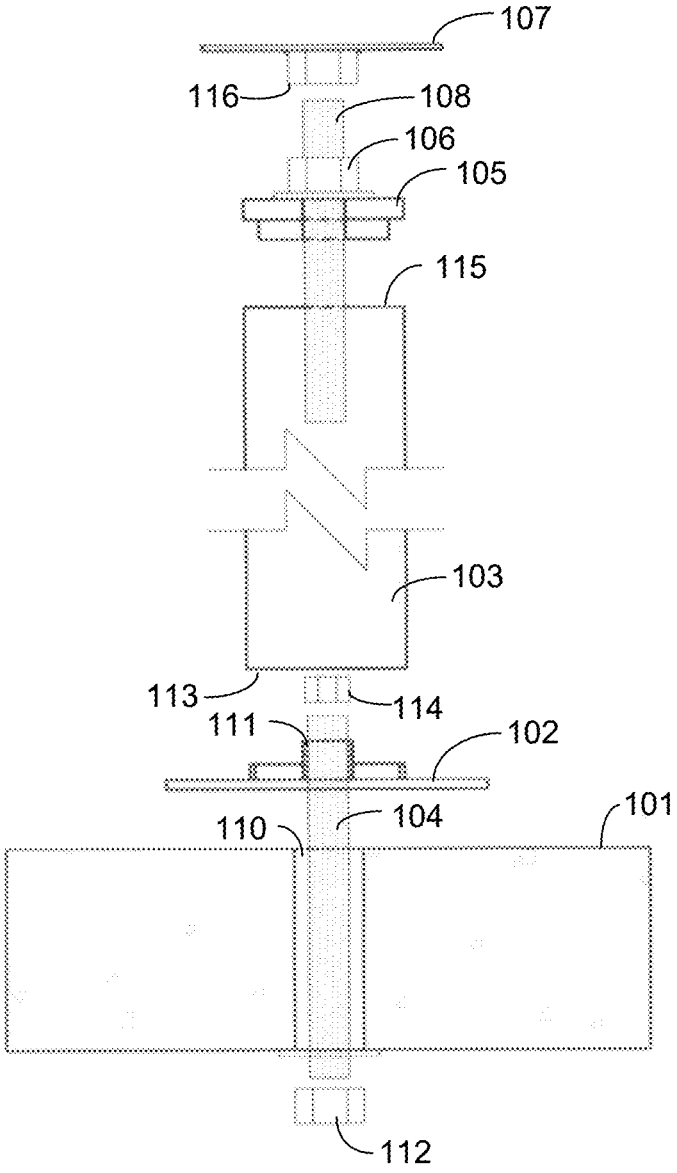
FIG. 1 is an exploded view of a floor support system according to an exemplary embodiment of the present disclosure

FIG. 1 is an exploded view of a floor support system 100 according to an exemplary embodiment of the present disclosure. The system 100 comprises a pad 101 that supports a post 103, the post 103 extending between the pad 101 and a joist (not shown). The pad 101 is a cylindrical block of concrete in one embodiment.

The pad 101 comprises a central opening 110 configured to receive a lower threaded rod 104, which lower threaded rod 104 extends generally vertically through the central opening 110. A nut 112 connects to a lower end of the lower threaded rod 104 and secures the pad 101 to the lower threaded rod 104 and to the post 103.

The post 103 comprises a cylindrical tube in one embodiment. In other embodiments, the post 103 may have a square cross-section instead of cylindrical. The post 103 further comprises a lower flange 102 that fits into a lower opening 113 of the post 103. The lower flange 102 further comprises an opening 111 that receives the lower threaded rod 104, the lower threaded rod 104 passing through the opening 111 and thus through the lower flange 102. A nut 114 connects to an upper end of the lower threaded rod 104 to secure the lower flange 102 to the pad 101.

The post 103 frictionally fits on the lower flange 102 to secure the post 103 to the lower flange 102. The frictional fit is created by the post 103 and the centering guide 302. Both the post 103 and the centering guide 302 have a diameter and generally complimentary shape, i.e., the post 103 is cylindrical, the centering guide is also cylindrically shaped. In one embodiment, the diameter of the post 103 and centering guide 302 are different and the post 103 has a larger diameter that allows the centering guide 302 to fit within the lower opening 113 of the post 103. Alternatively, it may be desirable for the post 103 to have a smaller diameter than the centering guide 302 such that the post 103 fits within the boundaries of the centering guide. In one embodiment, the post 103 has an outside diameter between 2.5 and 4 inches in one embodiment. The post 103 is formed from hot dipped galvanized steel in one embodiment.

An upper insert 105 is disposed on an upper end 115 of the post 103. The upper insert 105 frictionally fits within the upper end 115 of the post 103. The upper insert 105 comprises a central opening that receives an upper threaded rod 108 that extends through the upper insert 105. A nut 106 is disposed on the top side of the upper insert 105.

A joist flange 107 attaches to the joist (not shown) and comprises a female fitting 116 into which the upper threaded rod 108 threads in the illustrated embodiment. Alternatively, the joist flange 107 may be welded or otherwise affixed to the upper threaded rod 108.

In order to install the system 100, soil where the pad 101 is to be installed is excavated, generally twelve inches below adjacent grade. The pad 101 then placed in the excavated area, and soil (not shown) is packed around the pad 101.

When the post 103 is secured to the joist via the joist flange 107, and secured to the pad 101, the post 103 may be extended by a tool, such as a wrench (not shown), turning the nut 106. In this manner, the post 103 is extended to jack up the joist. The design provided by the floor support system disclosed herein allows the joist flange 107 to be moved separately and independently from the lower flange 102. If an installer only wishes to extend the joint flange 107 upwardly from the post 103, such movement may be obtained by turning the nut 106.

Figure 2:
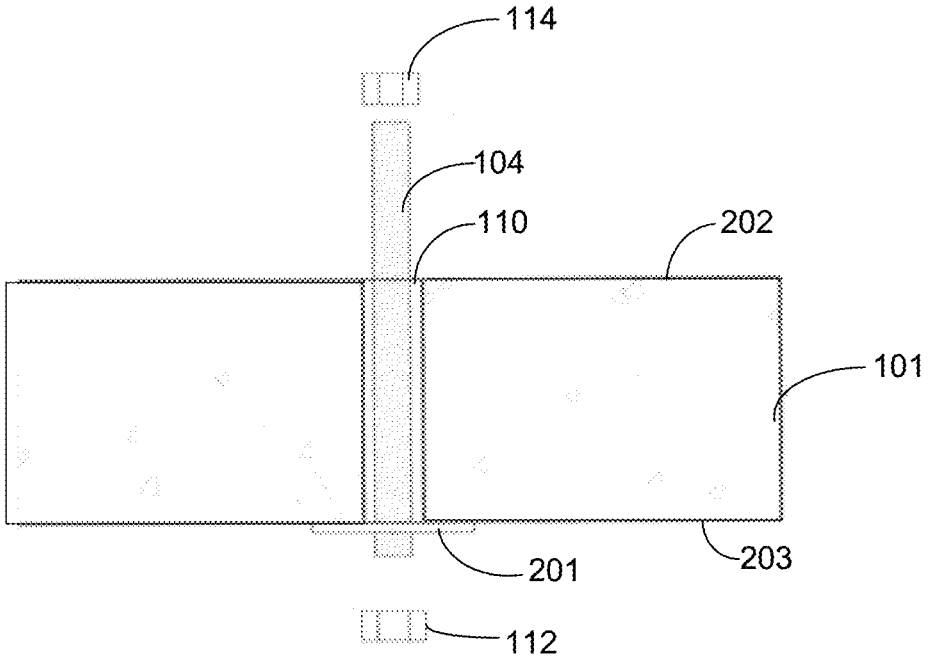
FIG. 2 depicts the pad of FIG. 1 with the lower threaded rod extending through the pad.

FIG. 2 depicts the pad 101 of FIG. 1 with the lower threaded rod 104 extending through the pad 101. In one embodiment, the pad 101 is approximately six (6) inches thick and sixteen inches in diameter. In other embodiments, the pad 101 may be differently sized and shaped, provided that the pad 101 provides a sufficiently stable and level base for the post 103 and a centering connection point 110. For example, the pad 101 may be cube-shaped or rectangular instead of cylindrical, in other embodiments.

The central opening 110 of the pad 101 extends generally vertically through the pad 101, from a top side 202 of the pad 101 to a bottom side 203 of the pad 101. The central opening 110 has a diameter slightly larger than a diameter of the lower threaded rod which allows the central opening 110 to help center the post 103.

A washer 201 is disposed on the bottom side 203 of the pad, between the bottom side 203 and the nut 112 that secures the pad 101 to the lower threaded rod 104. The washer 201 is a flat circular plate with a central opening in the illustrated embodiment. The washer 201 may be differently shaped in other embodiments.

The lower threaded rod 104 is ⅝"×8 inch all thread in one embodiment with a hex nut 114 on its upper end and a hex nut 112 on its lower end.

Figure 3:
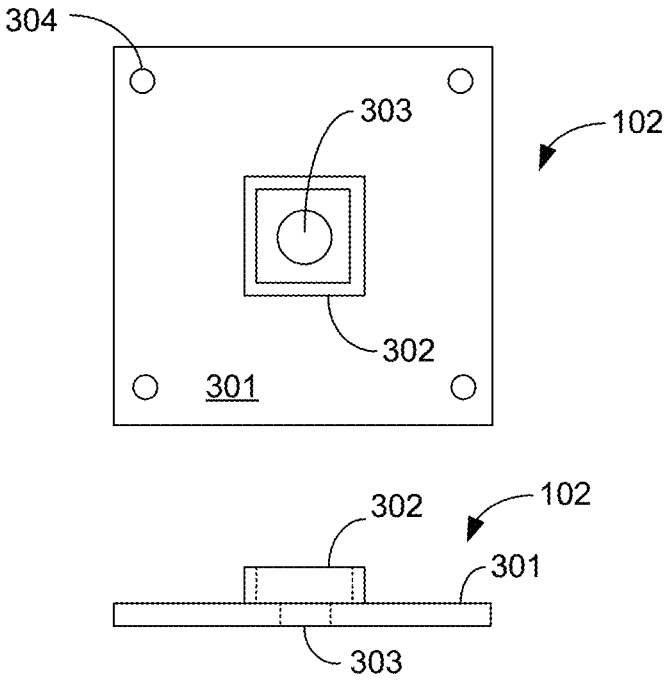
FIG. 3 depicts a top and side view of an exemplary embodiment of the lower flange of FIG. 1.

FIG. 3 depicts a top and side view of an embodiment of the lower flange 102 of FIG. 1. In this embodiment, the lower flange 102 is square shaped, with four substantially equal sides. In other embodiments, the lower flange 102 is round. The lower flange 102 is formed from steel in one embodiment but can be formed from any suitably strong and rigid material.

The lower flange 102 comprises a flat base 301 with a centering guide 302 extending from the base 301. The base 301 is generally six inches square in one embodiment, and ¼ inches thick.

The centering guide 302 extends upwardly from the flat base 301 a distance of up to ½ inch in one embodiment. The centering guide 302 is square shaped in this embodiment, and frictionally fits within a square-shaped post (not shown). The centering guide 302 is welded to the flat base 301 in one embodiment.

A central opening 303 extends through the lower flange 102. The central opening 303 is sized to receive the lower threaded rod 104 (FIG. 1). Four openings 304 are disposed in the corners of the flat base 301. The openings receive fasteners (not shown) that fasten the flat base 301 to the pad 101 in some embodiments.

Figure 4:
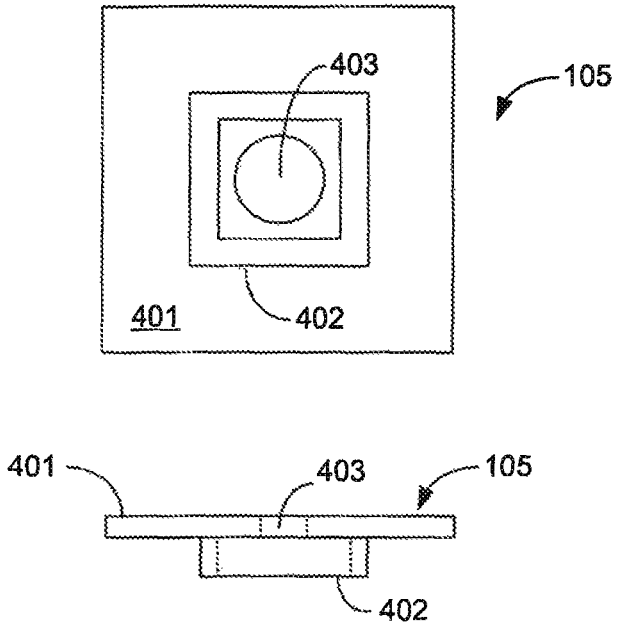
FIG. 4 depicts a top and side view of an exemplary embodiment of the upper insert of FIG. 1.

FIG. 4 depicts a bottom and side view of an embodiment of the upper insert 105 of FIG. 1. In this embodiment, the upper insert 105 is square shaped, with four substantially equal sides. In other embodiments, the lower flange is round. The upper insert 105 is formed from steel in one embodiment but can be formed from any suitably strong and rigid material.

The upper insert 105 comprises a base portion 401 and a centering guide 402. In one embodiment, the base portion comprises a flat plate that is four inches by four inches square, and ⅜ inches thick. The centering guide 402 extends upwardly from the base 401 a distance of up to ½ inch in one embodiment. The centering guide 402 is square shaped in this embodiment, and frictionally fits within a square-shaped post (not shown). The centering guide 402 is welded to the flat base 401 in one embodiment.

A central opening 403 extends through the upper insert 105. The central opening 403 is sized to receive the upper threaded rod 108 (FIG. 1).

Figure 5:
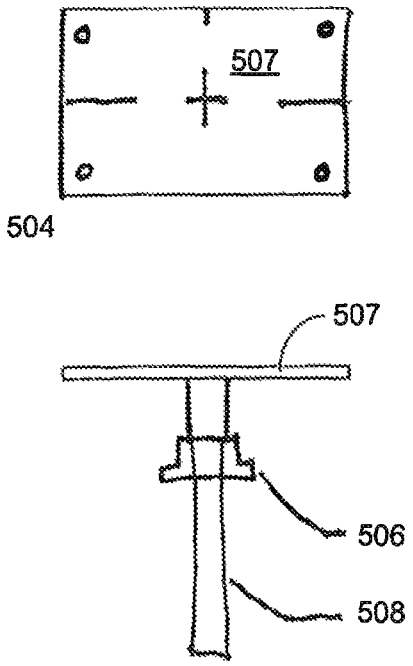
FIG. 5 depicts a top and side view of a joist flange according to an embodiment of the present disclosure.

FIG. 5 depicts a top and side view of a joist flange 507 according to one embodiment. The joist flange 507 comprises a rectangular flat plate, six inches by four inches and ¼ inches thick. In this embodiment, an upper threaded rod 508 is welded to the joist flange 507. The upper threaded rod 508 is 1 inch all thread, up to six inches long in one embodiment, and the nut 506 is a one-inch heavy hex nut.

Although the support system disclosed herein has been described in connection with supporting a sagging floor, it should be realized that the system could be used to support any support beam in need of support.

The invention claimed is:

1. A support system comprising a post vertically disposed between a pad and a joist, said post comprising upper and lower ends and an aperture in at least the lower end, wherein (i) a joist flange is located at the terminus of the post's upper end and a lower flange is located at the terminus of the post's lower end, (ii) the lower flange and the joist flange move independently relative the post from one another, and (iii) a threaded rod is disposed in the aperture of the post and passes through the lower flange and the pad.

2. The support system of claim 1 wherein the post comprises an upper insert disposed within the upper end of the post, said upper insert comprising an opening configured to receive a threaded rod.

3. The support system of claim 2, wherein the post is frictionally secured to the lower flange.

4. The support system of claim 3 wherein the lower flange comprises a centering guide having a first diameter and the post has a second diameter and wherein the second diameter is greater than the first diameter.

5. The support system of claim 1, wherein the wherein the post is frictionally secured to the lower flange.

6. A floor support system comprising:

a. a post, said post extending upward vertically from a pad and further comprising upper and lower ends and at least an aperture in the upper and lower ends, wherein said lower end is secured to a lower flange, said lower flange comprising a raised centering guide;

b. an upper insert, said upper insert comprising a raised centering guide which is inserted into the upper end of the post;

wherein (i) the lower flange and the upper insert are secured to the post via a frictional fit and (ii) a first threaded rod is disposed in the upper aperture of the post and terminates on one end at the joist flange and a second threaded rod is disposed in the lower aperture of the post and passes through the lower flange and the pad.

7. The floor support system of claim 6 wherein the post is shaped as a square.

8. The floor support system of claim 6 wherein the post is cylindrical.

* * * * *